United States Patent [19]

Napoleon et al.

[11] Patent Number: 4,797,977

[45] Date of Patent: Jan. 17, 1989

[54] PICKER ASSEMBLY

[75] Inventors: David P. Napoleon; Salvatore J. Centofanti, both of Philadelphia, Pa.

[73] Assignee: General Felt Industries, Inc., Saddle Brook, N.J.

[21] Appl. No.: 192,647

[22] Filed: May 11, 1988

[51] Int. Cl.[4] ..... D01B 1/00; D01G 19/00

[52] U.S. Cl. ..... 19/97; 19/129 R

[58] Field of Search ..... 19/80 P, 82, 85, 9 H, 19/97, 112, 129 R

[56] References Cited

U.S. PATENT DOCUMENTS

| | | | |
|---|---|---|---|
| 449,438 | 3/1891 | Frantz | 130/27 Q |
| 663,583 | 12/1900 | Scaife | 19/85 |
| 1,608,653 | 11/1926 | Harlan | 19/97 |
| 2,175,131 | 10/1939 | Schwartz | 19/112 |
| 2,429,157 | 10/1947 | Fowler | 241/294 |
| 2,694,835 | 11/1954 | Sofio | 19/97 |
| 2,700,189 | 1/1955 | Mick | 19/97 |
| 2,985,923 | 5/1961 | Köhler | 19/129 R |
| 3,264,690 | 8/1966 | Morrill | 19/112 |
| 3,445,895 | 5/1969 | Barbod | 19/97 |
| 4,342,137 | 8/1982 | Ennis et al. | 19/97 |
| 4,627,131 | 12/1986 | Iwata | 19/97 |

*Primary Examiner*—Louis K. Rimrodt

*Attorney, Agent, or Firm*—Mason, Fenwick & Lawrence

[57] ABSTRACT

There is disclosed a picker assembly comprising a picker bar having a T-slot therein and a plurality of picker teeth. The picker teeth have bases in the slot with wedging surfaces thereon for maintaining the teeth against a surface of the bar when the tooth working portion strikes the work, to prevent movement of the bases, and wearing of the teeth bases and picker bar.

15 Claims, 3 Drawing Sheets

PICKER ASSEMBLY

BACKGROUND OF THE INVENTION

Picker machines are conventionally used to open or separate fibers from a fiber mat comprised of cotton, jute or the like. A typical picker machine comprises plural cylinders having a plurality of picker assemblies thereon, each of which has a multiplicity of picker teeth which strike and open the fiber mat. Rotation of the picker cylinder causes each picker tooth to contact the fiber mat once during each revolution of the cylinder. The picker teeth thereby open or separate the fibers of the mat.

In a typical picker machine installation, a feed roller advances stock toward a knife disposed between the feed roller and a picker cylinder. Rotation of the picker cylinder causes each picker tooth to strike the fiber stock once during each revolution of the cylinder. The teeth draw the stock across the knife and thereby sever portions of the stock. The severed portions are removed from the teeth for subsequent operations.

Among the known picker machines constructions, there is provided a cylinder having mounted in it a longitudinally extending picker bar having a T-slot therein, one leg of the T-slot opening through a side of the bar. The teeth each includes a working portion which is outside of the picker bar, and a base fitted in the slot, with a shank of the blade extending through the leg opening of the T-slot. Thus, the picker teeth have a profile of the base and shank which is of T-shape corresponding to the T-slot in the picker bar. The bases of the teeth are inserted into the T-slot from an end of the T-slot. The teeth were machined to close tolerances, to provide clearance between surfaces of the bases of the teeth and the corresponding surfaces of the picker bar to enable the teeth to be inserted into the picker bar. This resulted in substantial expenses in the manufacture of these teeth. The picker teeth are than held in position, as by an abutment which is secured in position against the end-most picker tooth base by a set screw or the like.

. Barbod U.S. Pat. No. 3,445,895 provides a picker assembly which includes a picker bar with a T-slot, and a plurality of picker teeth having bases in the slot of the picker bar, a shank of the blade extending through the leg opening of the T-slot. The bases are configured so as to enable a base to be removed by turning it through approximately 90°, so as to permit it to be withdrawn from the picker bar through the leg opening of the T-slot, rather than requiring the removal of all of the teeth bases through the end of the picker bar. The bases of the teeth are provided with side surfaces which lie in planes perpendicular to the axis of the T-slot.

Scaife U.S. Pat. No. 663,583 discloses a cotton batting machine in which a picker bar with an open-sided beveled slot receives picker teeth having bases with inclined front and rear surfaces and a flat bottom surface to mate with the surfaces of the beveled slot: the side surfaces of these bases are perpendicular to the longitudinal axis of the beveled slot.

Frantz U.S. Pat. No. 449,438 discloses a thrashing cylinder with removable teeth which have bases with inclined side surfaces. Each tooth is inserted to an individual pocket of corresponding shape in the cylinder.

Fowler U.S. Pat. No. 2,429,157 discloses a pressure roll with removable wear segments, the teeth having configured bases and the cylinder having a number of individual pockets or notches into which the tooth base is inserted.

In the picker assemblies hereinabove described in which a picker bar has a longitudinally extending slot in which the bases of picker teeth are assembled in side-by-side relationship, the providing of tolerances and clearances, as hereinabove noted, has been required in order to enable the insertion of the teeth bases into the slot. This construction has necessarily resulted in some play or movement of the teeth bases in the picker bars, so that when the working portion of the picker teeth engage the work, forces are applied to the bases to move them in planes perpendicular to the axis of the picker cylinder, as permitted by the clearances and tolerances. The repetitive engagement of the picker teeth with the work causes repeated impacting of the teeth against the adjacent surfaces of the picker bar, causing rapid wear on the bases and picker bars, resulting in more frequent tooth breakage which, in turn, leads to increased expenses for replacement teeth and bars, the associated labor costs, and down time of the picker machine.

In recent years, a substantial increase in maintenance costs and replacement of picker teeth and picker bars have been observed, due to wear of the teeth and bars, and breakage of the teeth. It has been found that this accelerated wear has been caused, at least in part, because there has in recent time only been available raw material which is more difficult to "pick". For example, for many years burlap bagging, which had been discarded after use, was available as a major component of the raw material. Such bagging has been replaced to a substantial extent by plastic bagging, and accordingly discarded burlap bagging is now uncommon and cannot readily be acquired as the major raw material for the picking operations. As a consequence, other material, primarily bagging, is used, but at the present time, the discarded bagging which is available as a raw material is heavier and harder to chop or pick than the previously used burlap bagging.

SUMMARY OF THE INVENTION

The picker assembly of the present invention comprises a generally linear picker bar has a T-slot therein including a leg opening through a side of the bar; a plurality of aligned picker teeth each has a working portion outside the bar for periodically contacting a workpiece, and a base in the slot. The teeth bases have the lateral surfaces thereof inclined, with the lateral surfaces of the bases of a first group of teeth inclined towards the shank of the working portion, and the lateral surfaces of the bases of another set of teeth oppositely inclined; the angle of each set is complimentary, so that when the teeth of one set are interposed between the teeth of the other set, the lateral surfaces of the bases are in engagement. The angle of the lateral surfaces of the bases of the teeth is at 25° to a plane parallel to the central plane of the working portion of the tooth and passing through the outer edge of the lateral surface. The height of the slot in the picker bar is slightly greater than the height of the bases of the teeth, so that when the teeth bases are subjected to a lateral force, a lateral face of one tooth will cooperate with the engaged lateral face of the adjacent tooth to wedge the adjacent tooth perpendicularly to the lateral direction, thus causing the teeth of one set to be urged radially outwardly with respect to the picker cylinder, and the teeth of the other set to be urged radially inwardly with respect to the picker cylinder; teeth of one set are urged against and maintained in contact with the bottom wall of the slot and the teeth of the other set are urged against and maintained in engagement with the top wall of the slot, the top wall being at a greater radius with respect to the picker cylinder than the bottom wall. The teeth of one set have a slightly greater height, from tip to base, than the teeth of the other set, so that when assembled in the picker bar, all of the teeth have the points of the working portions in a line.

Among the objects of the present invention are to provide a picker assembly which will have reduced wear of both the picker teeth and the picker bar.

Another object is the provision of a picker assembly in which breakage and replacement of picker teeth and replacement of picker bars is greatly reduced.

Still another object of the present invention is to provide a picker assembly in which breakage of picker teeth is significantly reduced.

A still further object of the present invention is to provide a picker assembly in which the picker teeth may be manufactured at lower cost than previously.

Another object of the present invention is to provide long wearing picker teeth which do not require machining of the tooth base, to thereby lower manufacturing costs.

A further object of the present invention is the provision of a picker assembly in which a lesser degree of tolerance in the manufacture of the teeth and parts is required.

Other objects and many of the attendant advantages of the present invention will be readily understood from a consideration of the following specification and claims, and of the appended drawings.

DETAILED DESCRIPTION OF THE PREFERRED EMBODIMENT

Figure 1:
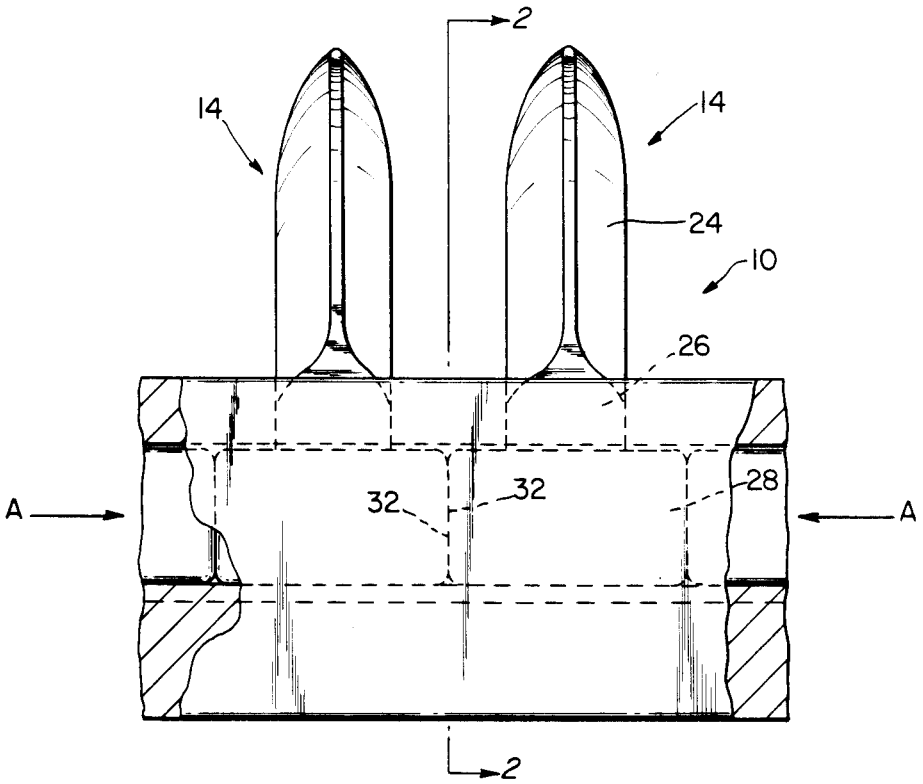
FIG. 1 PRIOR ART
FIG. 1 is a partial front elevational view of a conventional picker assembly, with parts in section.
Figure 2:
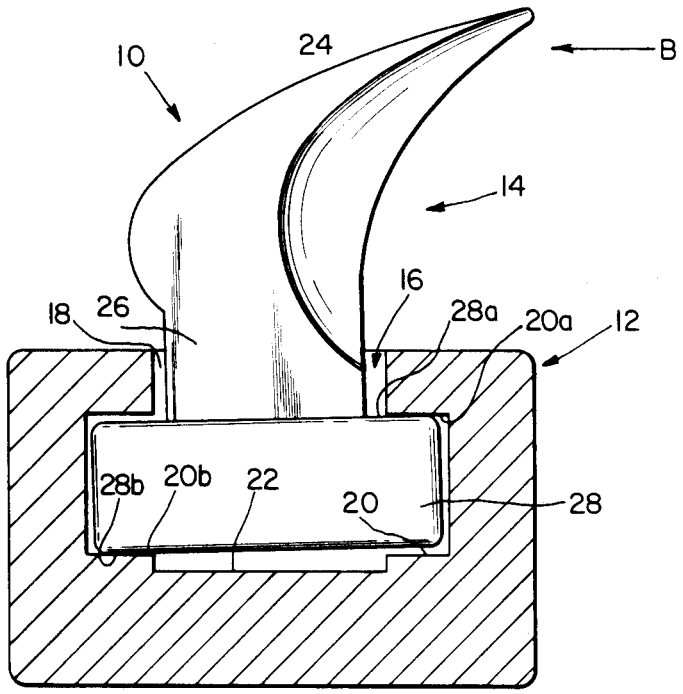
FIG. 2 PRIOR ART
FIG. 2 is a cross-sectional view of FIG. 1 taken substantially along line 2—2 thereof as viewed in the direction indicated by the arrows.

Referring to FIGS. 1 and 2, there is shown a typical picker assembly 10 of the type heretofore used and described above. The picker assembly 10 comprises a picker bar 12 having a plurality of picker teeth 14. The picker bar 12 includes a T-slot 16 therein having a leg 18 opening through one side of the bar 12, a linearly extending head space 20, and a central depression 22. The head space 20 is machined to fairly close tolerances to receive the bases of the teeth 14 as will be more fully apparent hereinafter. The central depression 22 is provided in the bar 12 to reduce friction between the teeth 14 and the bar 12 during insertion of the teeth 14.

The teeth 14 each includes a working portion 24 outside the picker bar 12, a shank 26 extending through leg opening 18, and a base 28 fitted in the head space 20. The tooth 14 is made by forging the working portion 24, shank 26 and base 28 from metal in a conventional manner, machining the base 28 to be of complimentary shape in transverse cross-section to the head space 20 (FIG. 2) and to fit in the head space 20 with predetermined clearance and then hardening the working portion 24, shank 26 and base 28. The head space 20 of the slot 16 is slightly larger than the base 28 in order to allow the teeth 14 to be inserted from one end of the picker bar 12. As indicated schematically in FIG. 1, the teeth 14 are secured in the bar 12 by a suitable clamp (not shown) which forces the bases 28 toward each other as indicated by the arrow A.

FIG. 2 shows the relationship between the tooth 14 and the picker bar 12 as the tooth contacts the work. It will be understood that the picker assembly 10 is mounted in a cylinder, the axis of rotation of which is below picker assembly 10 as shown in FIG. 2, rotation being clockwise. It will be seen that a force is applied to the tooth 14 in the direction shown by the arrow B to tilt the base 28 in the head space 20. When the tooth 14 disengages from the work, the force is no longer applied to the tooth 14 and the tooth base 28 tends to straighten in the head space 20. The base 28 is accordingly tilted in the head space 20 once for each revolution of the picker cylinder. The tooth 14 suffers a single substantial impact for each revolution of the picker cylinder and the tooth base 28 is thereby oscillated once for each revolution of the picker cylinder. This causes the tooth base 28 to strike corresponding surfaces of the picker bar 12. More particularly, upper base surface **28*a*, as shown in FIG. 2, and the inner or bottom surface 28*b* of base 28 will strike the top or outer wall 20*a* and the inner or bottom wall 20*b* of the picker bar 12, respectively, which define the head space 20. Once these surfaces have become engaged, the force indicated by arrow B may continue to be applied until the tooth is disengaged from the mat. As a result there will be a continued impacting and wearing of the base 20 and picker bar 12. In addition, due to the continued application of the force B and the repetitions of this force during use of the picker machine, breakage of the tooth 14 may occur due to fatigue caused by the repetitive blows. It has also been observed that the bases 28, moving in planes perpendicular to the cylinder axis, experience significant wear on the lateral surfaces 32 (FIG. 1) of the bases 28, contributing to the additional clearance and the ability of the teeth 14** to move and cause wear, with consequent deleterious results as above mentioned.

As hereinabove noted, another disadvantage of picker assemblies of the previously mentioned design is that the bases 28 and the head space 20 must be machined to fairly close tolerances in order to provide a reasonably snug initial fit between the picker bar 12 and the teeth 14. If the clearance is too small, the teeth 14 cannot be inserted through the open end of the picker bar 12. If the clearance is initially too large, the problem of breakage is accentuated. Furthermore, the central depression 22 must also be machined in the picker bar 12 to reduce sliding friction in order to facilitate insertion the teeth 14 into the T-slot 16. These machining operations constribute substantially to the high cost of picker bars and picker teeth of the type previously mentioned.

Referring now to FIGS. 3–6, there is illustrated a picker assembly 40 in accordance with one embodiment of this invention, comprising as major components a picker bar 42, two different types of picker teeth 44, 46 and means 48 for forcing the picker teeth 44, 46 toward each other. As will be more fully apparent hereinafter, the forcing means 48 cooperates with the inclined surfaces of the teeth bases to provide means for wedging and maintaining the teeth bases into tight engagement with the picker bar 42 when the teeth strike material, and prior and subsequent thereto, preventing movement of the bases transversely of the slot 16.

The picker bar 42 is generally similar to the prior art picker bar and comprises a body 50 having a T-slot 52 therein including a leg 54 opening onto one side of the picker body 50 and a head space 56 for receiving the teeth bases. In contrast to the prior art picker bars, the slot 52 need not be machined to close tolerances.

The teeth 44 each includes a working portion 64, a shank 66, and a base generally designated as 68. The lateral sides 70 and 72 of the base 68 of tooth 44 converge upwardly towards the central plane of the working portion 64. Each of the teeth 46 comprises a working portion 84, shank 86 and base 88 having lateral sides 92 and 94 which diverge from the working portion 84.

Figure 3:
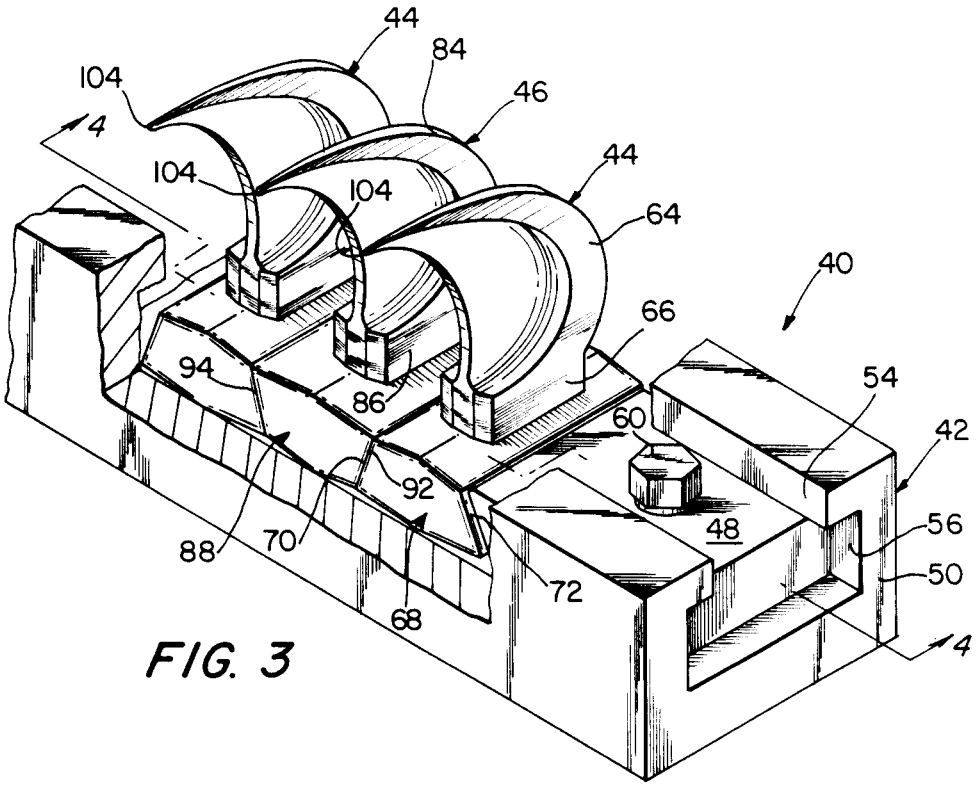
FIG. 3 is a perspective view with parts broken away of a picker assembly in accordance with this invention.
Figure 4:
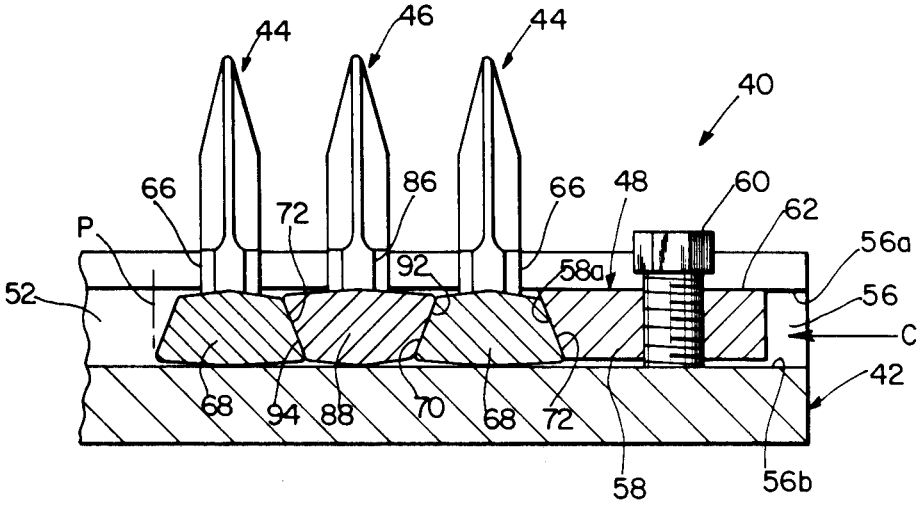
FIG. 4 is a longitudinal cross-sectional view of the picker assembly of this invention as taken substantially along line 4—4 of FIG. 3 as viewed in the direction indicated by the arrows.

In FIG. 4, a plurality of the teeth 44 and a single illustrative tooth 46 are shown, the shanks 66 and 86 extending through the leg opening 54, with the bases 68 and 88 lying in the head space 56 and being of lesser height than the height of the head space 56. The forcing means 48 comprises an abutment block 58 with a lateral side 58 inclined and engaging a lateral side 72 of base 68 of the tooth 44. A set screw 60 is used to secure the block 58 in position, after being urged in the direction of the arrow C. The height of the block 58 is shown to be slightly less than the height of the head space 56, so that the upper surface 62 is in engagement with the top or outer wall **56*a* of head space 56, while the end of the screw 60 is in engagement with the inner or bottom wall 56*b* of head space 56. The reference to inner and outer surfaces is in relation to the axis of the cylinder in which the picker assembly 40 is positioned, the axis of which will be below the picker assembly 40 as shown in FIGS. 3 and 4. The bottom surface of the base 68 of tooth 44 will be urged, by the cooperating wedging surfaces 58*a* and 72, to and against the surface 56*b*, and maintained thereagainst. Similarly, the upper or outer surface of the base 88 of tooth 46 will be urged by the wedging action of surfaces 70 and 92 against and maintained against the surface 56*a*. Also, the respective wedging surface 94 engages and urges the lateral side or surface 72 of the leftmost base 68, wedging that base 68 downwardly against the surface 56*b* of picker bar 42. The opposite end of the picker bar 42 may have a forcing means 48 similar to that shown in FIGS. 3 and 4**, or alternatively may have a fixed abutment or block.

Due to the above noted configuration of the bases 68 and 88 of the picker teeth 44 and 46, respectively, and with the cooperation of the forcing means 48, each of the bases 68 and 88 is maintained against a wall **56*a* or 56*b* of the picker bar 42, and this engagement of the bases with the picker bar 42 continues when each of the blades 44 and 46 is subjected to forces which are occasioned by the working portions 64 and 84 engaging the work, such as a mat of fibers. Consequently, there is obviated the relative movement between the bases and the picker bar upon the teeth striking the fiber mat, as in previously known constructions. The inclined lateral surfaces of the bases comprise wedging surfaces, the surface 58*a* on the block 58 also being a wedging surface and block 58** simultaneously maintains the bases against the bar and forces the bases towards each other.

Figure 5:
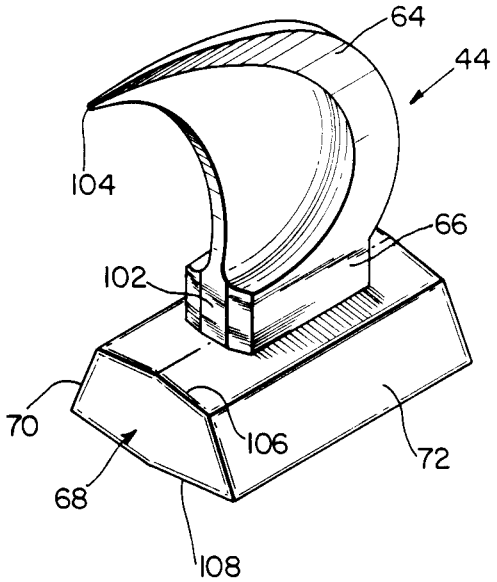

In FIG. 5, there is shown a perspective view of a tooth 44, including the working portion 64, shank 66 and base 68. The shank 66 is of generally rectangular cross-section, but may be provided with a reduced front surface 102 generally beneath the tip 104 of working portion 64. The upper surface 106 and the lower surface 108 of the base 68 may be somewhat arcuate, having a greater height in the region of the shank 66 than where these surfaces meet the lateral surfaces 70 and 72.

Figure 6:
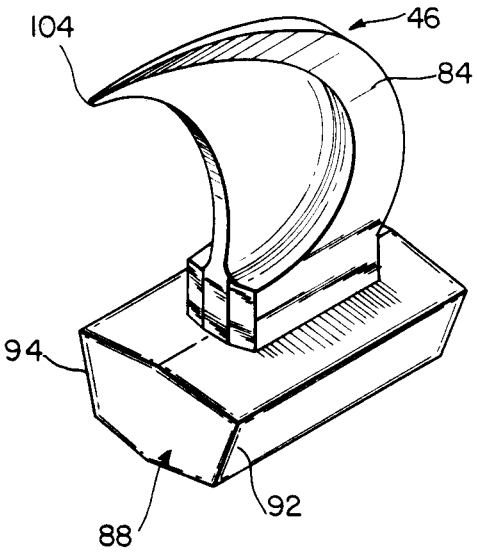
FIGS. 5 and 6 are perspective views of the two types of picker teeth used in the embodiment of FIGS. 3 and 4.

In FIG. 6, there is shown in perspective view a tooth 46, with working portion 84 and base 88. The lateral surfaces 92 and 94 are shown diverging away from the working portion 84, the configuration and characteristics of the tooth 46 being substantially the same as that of tooth 44, but with the following exception. The height of the tooth 44 will be slightly greater than the height of the tooth 46, so that the points 104 of the working portions 64 and 84 will be in alignment, thereby compensating for the relationship shown in FIG. 4, in which the upper surface of base 88 is in engagement with the surface **56*a*, with a space between the bottom surface thereof and the surface 56*b*, while the upper surface of the base 68 is spaced from the surface 56*a*, the bottom surface of base 68 engaging the surface 56*b***.

It has been found that the angle of the lateral side surfaces 70 and 72 and of the lateral side surfaces 92 and 94 should be at 25°, for optimum results, the angle being measured in each case between the surface and a plane P (see FIG. 4) which is parallel to the central plane of the tooth 44 and which extends through the outermost edge of that surface.

The inclination of the side surfaces of the bases enables them to function as mating wedging surfaces, to achieve the above-mentioned results of forcing and maintaining the respective surfaces of the bases 68 and 88 against surfaces of the picker bar 52. This substantially prevents tilting and impacting of the bases against the picker bar when the picker teeth strike the mat or fiber. Since, however, there may be some clearance with resulting movement and impacting after usage of the picker assembly 40, it is a simple, substantially cost free and expedient matter to correct the situation by tightening the teeth 44 and 46 by loosening and repositioning the forcing means 48. As will be appreciated, substantial clearances between surfaces of the bases 68 and 88 will be larger than in the previously known picker assemblies, and consequently close machine tolerances are not required, thereby avoiding attendant expenses.

Although a simple forcing means 48 has been illustrated, other constructions may be used in which a force in the direction of arrow C may be imposed upon the bases of the teeth 44 and 46 in the picker bar 42, to thereby maintain the above noted surface-to-surface engagement of the sides of the bases with each other, and the top and bottom surfaces of the bases with the surfaces of the picker bar, as above noted.

It will be appreciated that the slot in the picker bar is preferably T-shaped, but could have other configurations.

Figure 7:
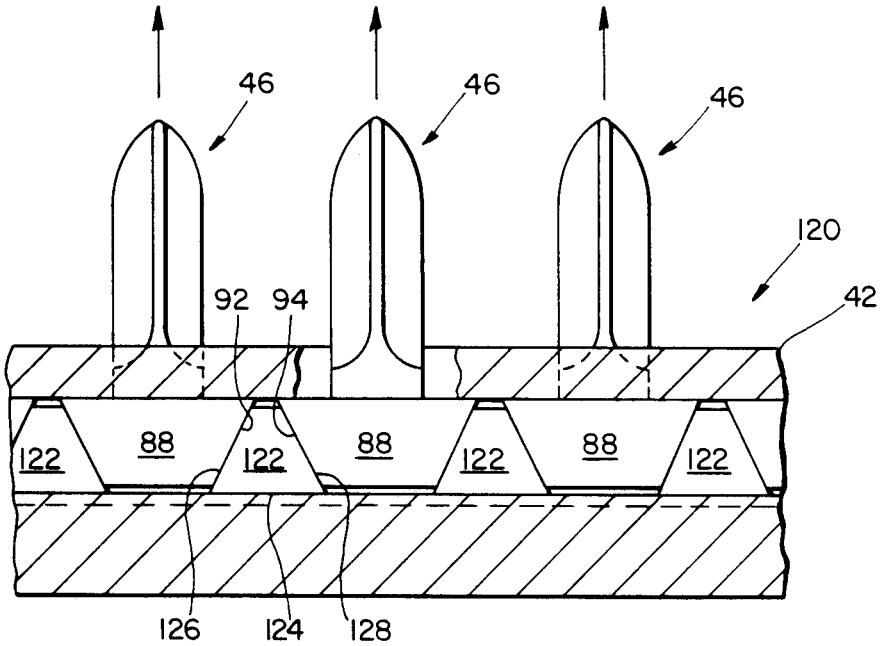
FIG. 7 is a longitudinal cross-sectional view, similar to FIG. 4, illustrating another embodiment of this invention.

Referring to FIG. 7, there is illustrated a picker assembly 120 comprising another embodiment of this invention. The picker assembly 120 comprises a picker bar 42, a plurality of picker teeth 46, a plurality of spacing means 122 disposed between adjacent teeth 46 and means (not shown) for forcing the picker teeth 46 toward each other.

The spacing means 122 comprise a body of generally trapezoidal configuration in cross-section including a bottom surface 124 for sliding along the head space 132 and a pair of inclined surfaces 126, 128 which provide co-mating wedging surfaces with the side bearing surfaces 92, 94 of the base 88.

It will be readily seen that actuation of the forcing means will advance the teeth 46 toward each other and, because of the reaction against the spacing means 122, urge the picker teeth 46 in the direction of the working portion 64 and into tight fitting engagement with the picker bar 122. It should be noted that the teeth 46 all move upwardly as shown in FIG. 7 away from the axis of the cylinder in which picker assembly 120 is mounted or toward the work. Consequently, the overall height of all the teeth 46 may be substantially identical.

It will accordingly be seen that there is herein provided an improved picker assembly which is constructed to prevent substantial relative movement between the tooth bases and the bar upon periodic impact of the teeth with the work. This construction, therefore, enables the picker teeth and picker bars to be made with relatively lesser tolerances and therefore may be manufactured more cheaply than previously. Further, the avoidance of movement of the picker teeth in the picker bar reduces wear and avoids rapid replacement of picker teeth and bars. Hence, a construction which is less expensive to produce and less expensive to maintain is provided by the subject matter herein disclosed.

The claims and the specification describe the invention presented, and the terms that are employed in the claims draw their meaning from the use of such terms in the specification. Some terms employed in the prior art may be broader in meaning than specifically employed herein. Whenever there is a question between the broader definition of such term as sued in the prior art and the more specific use of the term herein, the most specific meaning is meant.

What is claimed is:

1. A picker assembly comprising:

(a) a linearly extending picker bar having a top wall and a bottom wall, a linearly extending T-slot in said picker bar comprising a head space of a predetermined height between said top wall and said bottom wall and a linearly extending opening through said top wall, (b) a plurality of picker teeth in said picker bar, each picker tooth having a blade outwardly of said picker bar, a base in said head space and a shank extending through said linear opening in said top wall, the height of said bases being less than the height of said head space, and (c) means for maintaining each of said bases against one of said top wall or said bottom wall of said picker bar prior to and upon said blade being subject to forces thereon when striking material.

2. The picker assembly of claim 1, wherein said means comprises means for substantially simultaneously maintaining said bases against the bar and substantially simultaneously forcing said bases against each other.

3. The picker assembly of claim 2, wherein said means comprises inclined wedging surfaces on the bases.

4. The picker assembly of claim 3, wherein the inclined wedging surfaces of adjacent bases comprise mating surfaces alternately converging and diverging toward the opening of the T-slot.

5. The picker assembly of claim 3, wherein the inclined wedging surfaces of said bases converge in the same direction, and further comprising a spacer between each two of said bases presenting mating wedging surfaces to the wedging surfaces of the bases.

6. The picker assembly of claim 3, wherein said forcing means comprises a member including a mating wedging surface to the wedging surface of the base of an end picker tooth, and means for securing said member in contact with the base of said end picker tooth.

7. A picker assembly comprising:

a picker bar having a linearly extending T-slot therein comprising a head space having a height transversely of the length thereof, and a leg extending through a wall of said picker bar, a plurality of picker teeth each having a working portion outside said picker bar and a base in said slot of lesser height than said head space, and means for preventing movement of said bases in and transversely of said slot caused by said teeth impacting work comprising means for urging said bases into engagement with said picker bar.

8. The picker assembly of claim 7, said movement preventing means comprising wedging surface means on said bases for urging said teeth transversely of said slot upon application of a force to said bases acting linearly of said picker bar.

9. The picker assembly of claim 8, wherein said bases are in adjacent abutting relationship, the wedging surfaces of a first group of teeth being at a complimentary angle to the wedging surface of a second group of teeth, the teeth of the second group disposed alternately between the teeth of the first group.

10. The picker assembly of claim 8, said wedging surface means being at an angle of substantially 25° relative to a plane parallel to the central plane of said tooth passing through the outer edge of said wedging surface means.

11. A picker tooth for a picker machine having a picker bar with a linearly extending T-slot, said tooth having a working portion and having a base for supporting said working portion and provided for insertion, together with the basis of other picker teeth, into the slot of a picker bar of a picker machine, said picker bar slot being larger than the base of the tooth and having a surface engageable by the base of the picker tooth, and a forcing device to subject the bases of the teeth in the slot of the picker bar to a lateral force extending generally along the length of the picker bar, the picker tooth comprising:

(a) a generally rectangular base having upper and lower surfaces, end surfaces, and lateral side surfaces having an extent greater than said end surfaces, (b) a working portion extending from said upper surface, (c) at least one said lateral side surface inclined relative to a median plane of said picker tooth passing through said working portion, said end surfaces and through and substantially perpendicular to said top and bottom surfaces for causing movement of said tooth base toward said upper or lower surface thereof upon said inclined lateral side surface being subjected to a lateral force extending generally along the length of the picker bar to thereby engage the upper or lower surface of said base with a surface of said picker bar slot.

12. The picker tooth of claim 11, said picker tooth base having a pair of oppositely disposed inclined lateral side surfaces.

13. The picker tooth of claim 12, said lateral side surfaces each being inclined at an angle of 25° to a plane parallel to said median plane and extending through an outer edge of said lateral side surface.

14. The picker tooth of claim 11, said lateral side surfaces each being inclined at an angle of 25° to a plane parallel to said median plane and extending through an outer edge of said lateral side surface.

15. A set of picker teeth each comprising a portion for impacting work and a base for insertion into a picker bar, a median plane of symmetry through said portion, and a base, said set comprising a first group and a second group of picker teeth, the bases of each tooth having inclined lateral side surfaces, the lateral side surfaces of the bases of one group inclined complimentarily to the lateral side surfaces of the bases of the other group.

* * * * *